US012590737B2

(12) United States Patent
Ohno et al.

(10) Patent No.: US 12,590,737 B2
(45) Date of Patent: Mar. 31, 2026

(54) REFRIGERATION CYCLE APPARATUS

(71) Applicant: DAIKIN INDUSTRIES, LTD., Osaka (JP)

(72) Inventors: Masao Ohno, Osaka (JP); Tetsuya Okamoto, Osaka (JP); Kazushi Hisayama, Osaka (JP); Kebi Chen, Osaka (JP); Yoshinobu Tsumura, Osaka (JP); Masanori Ukibune, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 267 days.

(21) Appl. No.: 17/956,931

(22) Filed: Sep. 30, 2022

(65) Prior Publication Data

US 2023/0020042 A1 Jan. 19, 2023

Related U.S. Application Data

(63) Continuation of application No. PCT/JP2021/010685, filed on Mar. 16, 2021.

(30) Foreign Application Priority Data

Mar. 31, 2020 (JP) ..... 2020-063772

(51) Int. Cl.
*F25B 7/00* (2006.01)

(52) U.S. Cl.
CPC ..... *F25B 7/00* (2013.01)

(58) Field of Classification Search
CPC ..... F25B 1/10; F24F 1/12
See application file for complete search history.

(56) References Cited

U.S. PATENT DOCUMENTS 5,277,554 A * 1/1994 Elson ..... F04B 39/00 417/363
5,306,121 A * 4/1994 Heflin ..... F16F 15/08 417/363
5,899,669 A * 5/1999 Van Grimberge .. F04B 39/0044 417/354
6,260,373 B1 * 7/2001 Rockwood ..... F16F 7/104 165/69

(Continued)

FOREIGN PATENT DOCUMENTS

CN 2575568 Y 9/2003
CN 111919065 A 11/2020

(Continued)

OTHER PUBLICATIONS

Extended European Search Report for European Application No. 21780800.5, dated Jul. 6, 2023.

(Continued)

*Primary Examiner* — Lionel Nouketcha
(74) *Attorney, Agent, or Firm* — Birch, Stewart, Kolasch & Birch, LLP

(57) ABSTRACT

A first intermediate plate and a second intermediate plate are supported by a bottom member through a plurality of second elastic members. The first compressor and the second compressor are supported by the first intermediate plate and the second intermediate plate, respectively, through a plurality of first elastic members.

6 Claims, 2 Drawing Sheets

(56) References Cited

U.S. PATENT DOCUMENTS

| | | | | |
|---|---|---|---|---|
| 6,354,558 | B1 * | 3/2002 | Li | F16F 1/3732 248/673 |
| 6,948,916 | B2 * | 9/2005 | Hebert | F25B 31/02 62/469 |
| 9,181,940 | B2 * | 11/2015 | Cullen, Jr. | F04B 39/121 |
| 2012/0304685 | A1 * | 12/2012 | Kiguchi | F24F 1/26 62/468 |
| 2021/0025643 | A1 | 1/2021 | Hisayama et al. | |

FOREIGN PATENT DOCUMENTS

| | | | |
|---|---|---|---|
| JP | 3-3636 | U | 1/1991 |
| JP | 5-44963 | A | 2/1993 |
| JP | 2000-111202 | A | 4/2000 |
| JP | 2000-161817 | A | 6/2000 |
| JP | 2010-243033 | A | 10/2010 |
| JP | 2015-114030 | A | 6/2015 |
| JP | 2019-178856 | A | 10/2019 |
| WO | WO 2019/188993 | A1 | 10/2019 |

OTHER PUBLICATIONS

International Search Report, issued in PCT/JP2021/010685, dated May 18, 2021.

Japan Office Action-Decision of Refusal for application No. 2020-063772 issued on Apr. 28, 2022.

Japan Office Action-Notice of Reasons for Refusal for application No. 2020-063772 issued on Apr. 28, 2022.

Japan Office Action-Reconsideration Report by Examiner before Appeal for application No. 2020-063772 issued on Apr. 28, 2022.

Written Opinion of the International Searching Authority, issued in PCT/JP2021/010685, dated May 18, 2021.

Japan Office Action-Decision of Refusal for application No. 2020-063772 issued on Nov. 30, 2021.

Japan Office Action-Notice of Reasons for Refusal for application No. 2020-063772 issued on May 18, 2021.

English translation of International Preliminary Report on Patentability and Written Opinion of the International Searching Authority for International Application No. PCT/JP2021/010685, dated Oct. 13, 2022.

* cited by examiner

REFRIGERATION CYCLE APPARATUS

CROSS REFERENCE TO RELATED APPLICATIONS

This application is a Continuation of PCT International Application No. PCT/JP2021/010685, filed on Mar. 16, 2021, which claims priority under 35 U.S.C. 119(a) to Patent Application No. 2020-063772, filed in Japan on Mar. 31, 2020, all of which are hereby expressly incorporated by reference into the present application.

TECHNICAL FIELD

The present disclosure relates to a refrigeration cycle apparatus.

BACKGROUND ART

Patent Document 1 discloses a heat pump outdoor unit with a first anti-vibration mount on a bottom plate of a machine chamber, and an intermediate base including a second anti-vibration mount, which is supported by the first mount and to which legs of a compressor are to be attached.

CITATION LIST

Patent Document

PATENT DOCUMENT 1: Japanese Unexamined Patent Publication No. 2010-243033

SUMMARY

A first aspect of the present disclosure is directed to a refrigeration cycle apparatus including: a housing (2) having a bottom member (3); and a plurality of compressors accommodated in the housing (2), the plurality of compressors at least including a first compressor (10) and a second compressor (20), the first compressor (10) and the second compressor (20) being supported by a first intermediate plate (15) and a second intermediate plate (25), respectively, through a plurality of first elastic members (11), the first intermediate plate (15) and the second intermediate plate (25) being supported by the bottom member (3) through a plurality of second elastic members (12).

DESCRIPTION OF EMBODIMENTS

Figure 1:
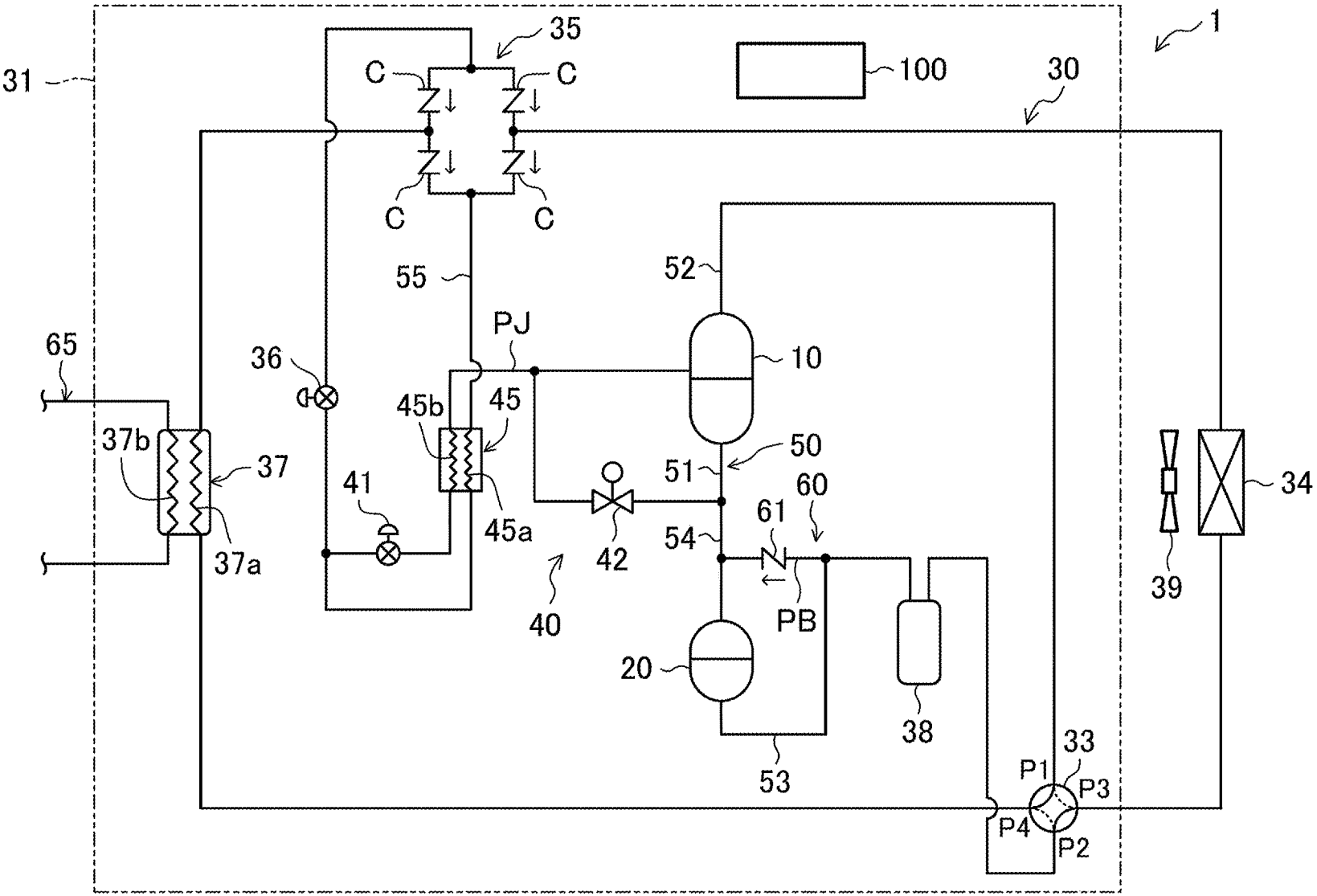
FIG. 1 is a piping diagram illustrating an example of a configuration of a refrigeration cycle apparatus of a present embodiment.

As illustrated in FIG. 1, a refrigeration cycle apparatus (1) is configured to heat a target fluid. The target fluid is water. The refrigeration cycle apparatus (1) is configured to supply the heated water to an apparatus utilizing the heated water, such as a hot water tank, a coil for indoor heating, or a coil for floor heating. The refrigeration cycle apparatus (1) is configured to cool the target fluid. The target fluid is water. The refrigeration cycle apparatus (1) is configured to supply the cooled water to an apparatus utilizing the cooled water, such as a coil for indoor cooling. The refrigeration cycle apparatus (1) includes a refrigerant circuit (30) and a control unit (100).

[Refrigerant Circuit]

The refrigerant circuit (30) includes a first compressor (10), a second compressor (20), a four-way switching valve (33), a heat-source-side heat exchanger (34), a check valve bridge (35), an expansion valve (36), a utilization-side heat exchanger (37), an accumulator (38), and an intermediate heat exchanger (45).

The refrigerant circuit (30) is filled with a refrigerant. The refrigerant circuit (30) performs a refrigeration cycle by circulating the refrigerant therein. The refrigerant is, for example, a refrigerant R410A, R32, or R407C.

<First Compressor>

The first compressor (10) is, for example, a scroll compressor. The first compressor (10) is provided on a discharge side of the second compressor (20). The first compressor (10) is connected with a first suction pipe (51) and a first discharge pipe (52). The first compressor (10) is configured to compress the refrigerant sucked therein and to discharge the refrigerant thus compressed. The first compressor (10) has a greater capacity than the second compressor (20).

The number of rotations of the first compressor (10) is variable. For example, the number of rotations of a motor is changed by changing an output frequency of an inverter (not illustrated) connected to the first compressor (10). As a result, the number of rotations (operation frequency) of the first compressor (10) changes.

<Second Compressor>

The second compressor (20) is, for example, a scroll compressor. The second compressor (20) is provided on a suction side of the first compressor (10). The second compressor (20) is connected with a second suction pipe (53) and a second discharge pipe (54). By connecting an inlet end of the first suction pipe (51) with an outlet end of the second discharge pipe (54), a connection pipe (50) is configured. The second compressor (20) and the first compressor (10) are connected with each other in series via the connection pipe (50). The second compressor (20) is configured to compress the refrigerant sucked therein and discharge the refrigerant thus compressed.

The number of rotations of the second compressor (20) is variable. For example, the number of rotations of a motor is changed by changing an output frequency of an inverter (not illustrated) connected to the second compressor (20). As a result, the number of rotations (operation frequency) of the second compressor (20) changes.

<Four-Way Switching Valve>

The four-way switching valve (33) is a solenoid-controlled switching valve. The four-way switching valve (33) switches between a first state (the state indicated by the solid lines in FIG. 1) and a second state (the state indicated by the dotted lines in FIG. 1). A first port (P1) is connected to the outlet end of the first discharge pipe (52). A second port (P2) is connected to the inlet end of second suction pipe (53). A third port (P3) communicates with a gas-side end of the heat-source-side heat exchanger (34). A fourth port (P4) communicates with a gas-side end of the utilization-side heat exchanger (37).

<Heat-Source-Side Heat Exchanger>

The heat-source-side heat exchanger (34) is an outdoor heat exchanger. In the vicinity of the heat-source-side heat exchanger (34), a fan (39) is provided. As a result of operation of the fan (39), heat exchange takes place between the refrigerant of the heat-source-side heat exchanger (34) and the outdoor air.

<Check Valve Bridge>

The check valve bridge (35) includes four check valves (C). Each of the four check valves (C) allows the refrigerant to flow in the direction indicated by the arrows in FIG. 1, and restricts the refrigerant from flowing in the opposite direction. To an inlet side of the check valve bridge (35), one end of a main liquid pipe (55) is connected. To an outlet side of the check valve bridge (35), the other end of the main liquid pipe (55) is connected. The check valve bridge (35) communicates with a liquid-side end of the heat-source-side heat exchanger (34) and a liquid-side end of the utilization-side heat exchanger (37).

<Expansion Valve>

The expansion valve (36) expands the refrigerant to lower the pressure of the refrigerant. The expansion valve (36) is an electronic expansion valve whose opening degree is adjustable. The expansion valve (36) is connected to the main liquid pipe (55).

<Utilization-Side Heat Exchanger>

The utilization-side heat exchanger (37) causes heat exchange between the refrigerant and the water. The utilization-side heat exchanger (37) includes a first channel (37*a*) and a second channel (37*b*). The first channel (37*a*) is a channel through which the refrigerant flows. The second channel (37*b*) is a channel through which the water flows. The second channel (37*b*) is connected to an intermediate portion of a utilization-side circuit (65) included in the apparatus utilizing the water (not illustrated). The utilization-side heat exchanger (37) causes heat exchange between the refrigerant flowing through the first channel (37*a*) and the water flowing through the second channel (37*b*).

<Accumulator>

The accumulator (38) is connected to an intermediate portion of the second suction pipe (53). The accumulator (38) is a gas-liquid separator. Inside the accumulator (38), the refrigerant is separated into a liquid refrigerant and a gas refrigerant. The accumulator (38) is configured to allow only the gas refrigerant to flow out of the accumulator (38).

<Bypass Circuit>

A bypass circuit (60) includes a bypass piping (PB) and a bypass check valve (61). The bypass piping (PB) is connected between the second suction pipe (53) and the connection pipe (50). The bypass check valve (61) allows the refrigerant to flow in a direction from the second suction pipe (53) to the connection pipe (50), and restricts the refrigerant from flowing in the opposite direction.

<Injection Circuit>

An injection circuit (40) is a circuit for supplying part of the refrigerant flowing through the main liquid pipe (55) to the suction side of the first compressor (10). The injection circuit (40) includes an injection piping (PJ), an injection expansion valve (41), and an open/close valve (42).

The injection piping (PJ) has one end connected between the expansion valve (36) and the check valve bridge (35) in the main liquid pipe (55). The injection piping (PJ) has the other end branched into two ends, one of which is connected with the first suction pipe (51) and the other one of which is connected with a compression chamber in the course of compression of the first compressor (10).

The injection expansion valve (41) is connected to a portion of the injection piping (PJ) upstream of the intermediate heat exchanger (45). The injection expansion valve (41) decompresses the refrigerant flowing through the injection piping (PJ).

The open/close valve (42) is switchable between an open state and a closed state. When the open/close valve (42) is in the open state, part of the refrigerant flowing through the injection piping (PJ) is supplied to the suction side of the first compressor (10). When the open/close valve (42) is in the closed state, the refrigerant flowing through the injection piping (PJ) is supplied to the compression chamber in the course of compression of the first compressor (10).

<Intermediate Heat Exchanger>

The intermediate heat exchanger (45) includes a third channel (45*a*) and a fourth channel (45*b*). The third channel (45*a*) is connected to an intermediate portion of the main liquid pipe (55). The fourth channel (45*b*) is connected to an intermediate portion of the injection piping (PJ). The intermediate heat exchanger (45) causes heat exchange between the refrigerant flowing through the third channel (45*a*) and the refrigerant flowing through the fourth channel (45*b*).

[Sensor]

The refrigeration cycle apparatus (1) includes various sensors, such as temperature sensors for detecting temperatures of the refrigerant etc. and pressure sensors for detecting pressures of the refrigerant etc. Signals indicative of detection results of the sensors are sent to the control unit (100).

[Control Unit]

The refrigeration cycle apparatus (1) includes the control unit (100). The control unit (100) includes a microcomputer and a memory device storing software for operating the microcomputer.

The control unit (100) is configured to control the refrigerant circuit (30) based on the signals from the various sensors and external control signals. The control unit (100) is configured to output control signals to the first compressor (10), the second compressor (20), the four-way switching valve (33), the expansion valve (36), the injection expansion valve (41), the open/close valve (42), and the like. The control unit (100) receives values detected by the various sensors.

[Operation of Refrigeration Apparatus]

The refrigeration cycle apparatus (1) performs heating operation and cooling operation. The refrigeration cycle apparatus (1) is configured such that the first compressor (10) functions as a high-pressure compressor and the second compressor (20) functions as a low-pressure compressor.

[Heating Operation]

In the heating operation, a refrigeration cycle is performed in which the utilization-side heat exchanger (37) serves a condenser (a radiator) and the heat-source-side heat exchanger (34) serves as an evaporator. Specifically, the four-way switching valve (33) is placed in the first state.

The refrigerant discharged from the first compressor (10) passes through the four-way switching valve (33), and dissipates heat to water to condense in the utilization-side heat exchanger (37). The refrigerant that has flowed out of the utilization-side heat exchanger (37) passes through the check valve bridge (35), and circulates through the main liquid pipe (55). The refrigerant circulating through the main liquid pipe (55) dissipates heat to the refrigerant flowing through the fourth channel (45*b*), and is supercooled, in the third channel (45*a*) of the intermediate heat exchanger (45). Thereafter, part of the refrigerant flowing through the main liquid pipe (55) flows into the injection piping (PJ), and the remaining part of the refrigerant is decompressed at the expansion valve (36) in the main liquid pipe (55).

The refrigerant thus decompressed passes through the check valve bridge (35) and evaporates in the heat-source-side heat exchanger (34). The refrigerant that has flowed out of the heat-source-side heat exchanger (34) sequentially passes through the four-way switching valve (33) and the accumulator (38), and is sucked into the second compressor (20) and compressed. The refrigerant discharged from the second compressor (20) is sucked into the first compressor (10) and is compressed.

On the other hand, the refrigerant that has flowed into the injection piping (PJ) is decompressed at the injection expansion valve (41), and absorbs heat from the refrigerant flowing through the third channel (45*a*) and evaporates in the fourth channel (45*b*) of the intermediate heat exchanger (45). Thereafter, the refrigerant flowing through the injection piping (PJ) is introduced into the first suction pipe (51) to the first compressor (10).

<Cooling Operation>

In the cooling operation, a refrigeration cycle is performed in which the heat-source-side heat exchanger (34) serves as a condenser (a radiator) and the utilization-side heat exchanger (37) serves as an evaporator. Specifically, the four-way switching valve (33) is placed in the second state. An explanation of the flow of the refrigerant during the cooling operation is omitted.

[Layouts of the Devices Inside the Refrigeration Cycle Apparatus]

Figure 2:
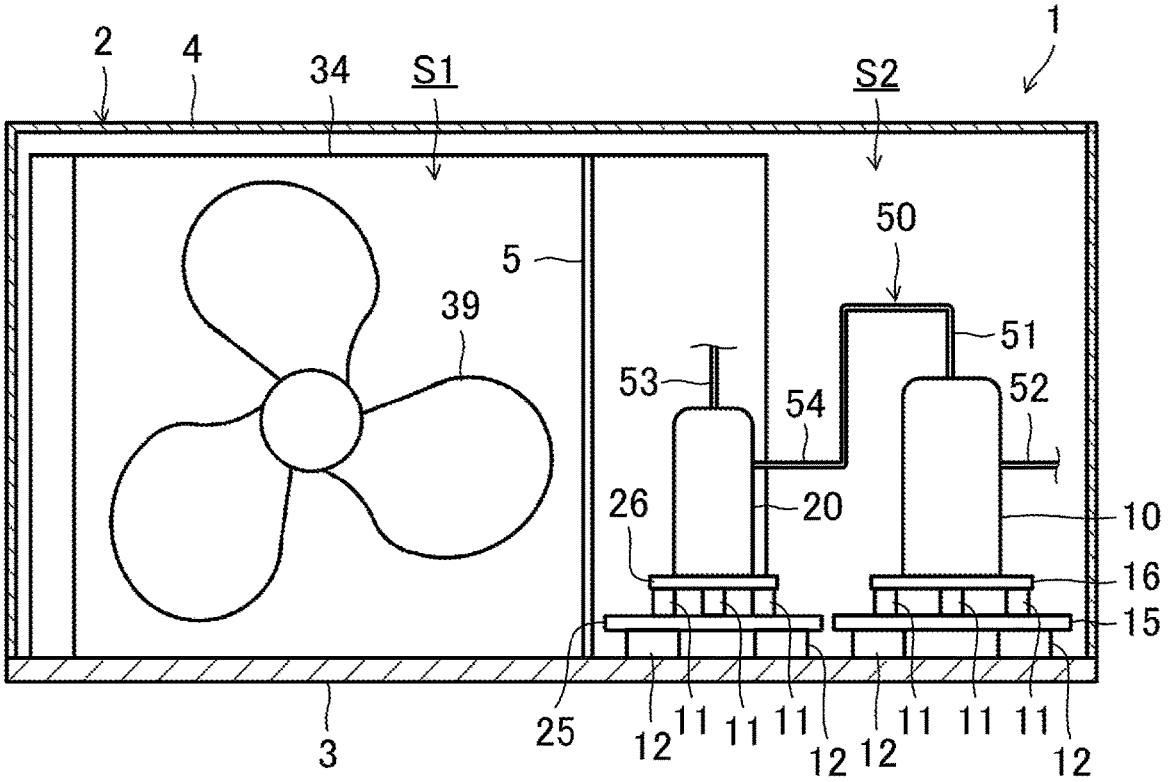
FIG. 2 is a front view illustrating the configuration of the refrigeration cycle apparatus.
Figure 3:
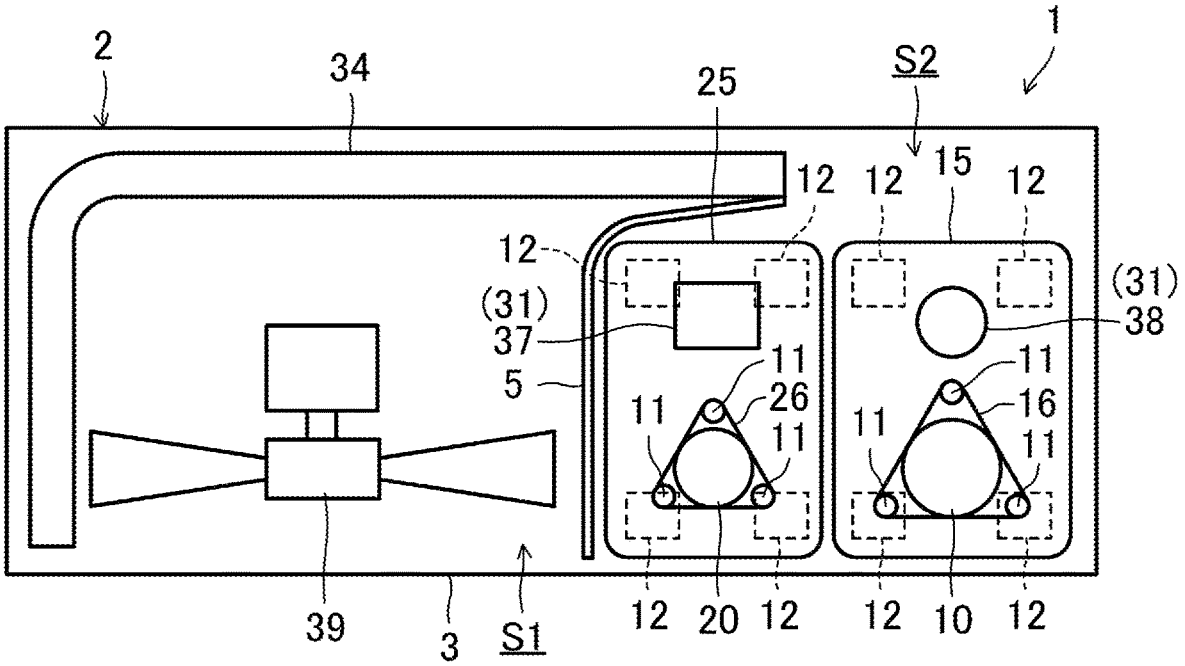
FIG. 3 is a plan view illustrating the configuration of the refrigeration cycle apparatus.

As illustrated in FIGS. 2 and 3, the refrigeration cycle apparatus (1) includes a housing (2). The housing (2) has a bottom member (3) and a cover member (4).

An interior of the housing (2) is partitioned into a heat exchange chamber (S1) and a machine chamber (S2) by a partition (5). The cover member (4) covers the heat exchange chamber (S1) and the machine chamber (S2). In the heat exchange chamber (S1), the heat-source-side heat exchanger (34) and the fan (39) are provided. As a result of operation of the fan (39), heat exchange takes place between the refrigerant flowing through the heat-source-side heat exchanger (34) and the outdoor air.

In the machine chamber (S2), the devices illustrated within the virtual frame line in FIG. 1 are provided. Specifically, the machine chamber (S2) accommodates the first compressor (10), the second compressor (20), and refrigerant circuit component parts (31) constituting the refrigerant circuit (30). Although not illustrated, the control unit (100) is located in the machine chamber (S2).

The first compressor (10) is supported by a first intermediate plate (15) through a plurality of first elastic members (11). Specifically, the first compressor (10) is provided with a first supporting leg (16). Between the first supporting legs (16) and the first intermediate plate (15), three first elastic members (11) are provided.

The first elastic members (11) may be a single large piece or may be two or more separate pieces as long as the first elastic member (11) or the first elastic members (11) can support the first compressor (10). The first elastic members (11) are made of rubber or urethan.

The first intermediate plate (15) is supported by the bottom member (3) of the housing (2) through a plurality of second elastic members (12). Between the first intermediate plate (15) and the bottom member (3), four second elastic members (12) are provided. The second elastic members (12) are provided at four corners of the first intermediate plate (15), respectively.

The second elastic members (12) may be a single large piece or may be two or more separate pieces. The second elastic members (12) are made of rubber or urethan. The first elastic members (11) and the second elastic members (12) may be made from the same material or different materials, and may have the same spring constant or different spring constants.

The first compressor (10) is placed on a double anti-vibration structure comprised of the first elastic members (11), the first intermediate plate (15), and the second elastic members (12). With this configuration, even if the first compressor (10) vibrates during the operation of the refrigeration cycle apparatus (1), transmission of the vibration and noise generation are reduced.

The second compressor (20) is supported by a second intermediate plate (25) through the plurality of first elastic members (11). Specifically, the second compressor (20) is provided with a second supporting leg (26). Between the second supporting legs (26) and the second intermediate plate (25), three first elastic members (11) are provided.

The first elastic members (11) may be a single large piece or may be two or more separate pieces as long as the first elastic member (11) or the first elastic members (11) can support the second compressor (20). The first elastic members (11) are made of rubber or urethan.

The second intermediate plate (25) is supported by the bottom member (3) of the housing (2) through the plurality of second elastic members (12). Between the second intermediate plate (25) and the bottom member (3), four second elastic members (12) are provided. The second elastic members (12) are provided at four corners of the first intermediate plate (15), respectively.

The second elastic members (12) may be a single large piece or may be two or more separate pieces. The second elastic members (12) are made of rubber or urethan. The first elastic members (11) and the second elastic members (12) may be made from the same material or different materials, and may have the same spring constant or different spring constants.

The second compressor (20) is placed on a double anti-vibration structure comprised of the first elastic members (11), the second intermediate plate (25), and the second elastic members (12). With this configuration, even if the second compressor (20) vibrates during the operation of the refrigeration cycle apparatus (1), transmission of the vibration and noise generation are reduced.

Thus, the first compressor (10) and the second compressor (20) vibrate independently of each other, and therefore resonance between the first intermediate plate (15) and the second intermediate plate (25) can be reduced.

The first compressor (10) and the second compressor (20) are connected with each other via the connection pipe (50) with flexibility. The connection pipe (50) includes a first suction pipe (51) and a second discharge pipe (54). The connection pipe (50) may have a flexible structure by having a plurality of bent portions, for example. The connection pipe (50) may be configured with a flexible pipe or a bellows pipe.

With this configuration, even if a positional displacement occurs between the first intermediate plate (15) and the second intermediate plate (25) due to the vibrations of the first compressor (10) and the second compressor (20), stress applied on the connection pipe (50) can be reduced.

Since the first compressor (10) has a greater capacity than the second compressor (20), the first compressor (10) is heavier than the second compressor (20). The overall weight of the first intermediate plate (15) and the first compressor (10) is therefore greater than the overall weight of the second intermediate plate (25) and the second compressor (20).

As illustrated in FIG. 3, a refrigerant circuit component part (31) constituting the refrigerant circuit (30) is placed on the first intermediate plate (15). In the example illustrated in FIG. 3, the refrigerant circuit component part (31) is an accumulator (38). In this way, the accumulator (38) is placed on the first intermediate plate (15), which is included in the greater overall weight, to further increase the overall weight, thereby making it possible to improve the vibration isolation performance.

Another refrigerant circuit component part (31) is placed on the second intermediate plate (25). In the example illustrated in FIG. 3, the refrigerant circuit component part (31) is a utilization-side heat exchanger (37). In this way, the utilization-side heat exchanger (37) is placed on the second intermediate plate (25), which is included in the smaller overall weight, to increase the overall weight of the second intermediate plate (25) with relatively poorer vibration isolation performance, thereby making it possible to improve the vibration isolation performance.

Although in this embodiment a refrigerant circuit component part (31) is placed on each of the first intermediate plate (15) and the second intermediate plate (25), a refrigerant circuit component part (31) may be placed on only one of the intermediate plates.

Although not illustrated in the drawings, refrigerant circuit component parts (31) other than the first compressor (10), the second compressor (20), the accumulator (38), and the utilization-side heat exchanger (37) may be arranged on the first intermediate plate (15) and second intermediate plate (25). Examples of the refrigerant circuit component parts (31) include the intermediate heat exchanger (45), the four-way switching valve (33), the check valve bridge (35), the expansion valve (36), the bypass check valve (61), etc.

Advantages of Embodiment

In a feature (1) of the embodiment, the first intermediate plate (15) and the second intermediate plate (25) are supported by the bottom member (3) through the plurality of second elastic members (12). The first compressor (10) and the second compressor (20) are supported by the first intermediate plate (15) and the second intermediate plate (25), respectively, through the plurality of first elastic members (11).

According to the feature (1) of the embodiment, the first compressor (10) and the second compressor (20) vibrate independently of each other, and therefore the resonance between the first intermediate plate (15) and the second intermediate plate (25) can be reduced.

In a feature (2) of the embodiment, a refrigerant circuit component part (31) is provided on at least one of the first intermediate plate (15) or the second intermediate plate (25).

According to the feature (2) of the embodiment, the vibration can be reduced by increasing the overall weight of the intermediate plate with the refrigerant circuit component part (31) placed thereon.

In a feature (3) of the embodiment, at least one of the refrigerant circuit component parts (31) is provided on the intermediate plate included in a greater one of the overall weight of the first intermediate plate (15) and the first compressor (10) and the overall weight of the second intermediate plate (25) and the second compressor (20).

According to the feature (3) of the embodiment, a refrigerant circuit component part (31) is provided on the intermediate plate included in the greater overall weight to further increase the overall weight, thereby making it possible to further improve the vibration isolation performance.

In a fourth feature of the embodiment, at least one of the refrigerant circuit component parts (31) is provided on the intermediate plate included in a smaller one of the overall weight of the first intermediate plate (15) and the first compressor (10) and the overall weight of the second intermediate plate (25) and the second compressor (20).

According to the feature (4) of the embodiment, the refrigerant circuit component part (31) is provided on the intermediate plate included in the smaller overall weight to increase the overall weight of the intermediate plate with relatively poorer vibration isolation performance, thereby making it possible to improve the vibration isolation performance.

In a feature (5) of the embodiment, a refrigerant circuit component part (31) is provided on each of the first intermediate plate (15) and the second intermediate plate (25).

According to the feature (5) of the embodiment, the weights on the first intermediate plate (15) and the second intermediate plate (25) are increased, so that the vibrations transmitting to the housing (2) can be reduced.

In a feature (6) of the embodiment, the first compressor (10) and the second compressor (20) are connected with the pipe (50) with flexibility.

According to the feature (6) of the embodiment, even if a positional displacement occurs between the first intermediate plate (15) and the second intermediate plate (25) due to the vibrations of the first compressor (10) and the second compressor (20), stress applied on the pipe (50) can be reduced.

Other Embodiments

The above-described embodiments may be modified as follows.

Even though this embodiment describes a configuration with two compressors, the embodiment may be configured with three or more compressors. In this case, another intermediate plate is provided in addition to the first intermediate plate (15) and the second intermediate plate (25), and a compressor is provided on this intermediate plate.

While the embodiments and variations have been described above, it will be understood that various changes in form and details can be made without departing from the spirit and scope of the claims. The above embodiments and variations may be appropriately combined or modified by replacing the elements thereof as long as the functions of the subject matters of the present disclosure are not impaired. In addition, the expressions of "first," "second," and "third" in the specification and claims are used to distinguish the terms to which these expressions are given, and do not limit the number and order of the terms.

INDUSTRIAL APPLICABILITY

As described above, the present disclosure is useful for a refrigeration cycle apparatus.

EXPLANATION OF REFERENCES

1 Refrigeration Cycle Apparatus
2 Housing
3 Bottom Member
10 First Compressor
11 First Elastic Member
12 Second Elastic Member
15 First Intermediate Plate
20 Second Compressor
25 Second Intermediate Plate
30 Refrigerant Circuit
31 Refrigerant Circuit Component Part
50 Connection Pipe

The invention claimed is:

1. A refrigeration cycle apparatus comprising:

a housing having a bottom member;

a plurality of compressors accommodated in the housing, the plurality of compressors at least including a first compressor and a second compressor, the first compressor being supported by a first intermediate plate through a first elastic member, the second compressor being supported by a second intermediate plate through the first elastic member, and the first intermediate plate and the second intermediate plate being supported by the bottom member through a plurality of second elastic members, wherein the first compressor is not supported by the second intermediate plate, and the second compressor is not supported by the first intermediate plate, and the plurality of second elastic members are positioned outward with respect to the first elastic member of each compressor, wherein the second elastic members are positioned at a greater distance from the center of each compressor than the first elastic member of said compressor in a plan view.

2. The refrigeration cycle apparatus of claim 1, wherein at least one refrigerant circuit component parts constituting a refrigerant circuit is provided on at least one of the first intermediate plate or the second intermediate plate.

3. The refrigeration cycle apparatus of claim 2, wherein at least one of the refrigerant circuit component parts is provided on the first intermediate plate, in a case an overall weight of the first intermediate plate and the first compressor has a greater overall weight than the second intermediate plate and the second compressor.

4. The refrigeration cycle apparatus of claim 2, wherein at least one of the refrigerant circuit component parts is provided on the first intermediate plate, in a case an overall weight of the first intermediate plate and the first compressor has a smaller overall weight than the second intermediate plate and the second compressor.

5. The refrigeration cycle apparatus of claim 1, wherein a refrigerant circuit component part constituting a refrigerant circuit is provided on each of the first intermediate plate and the second intermediate plate.

6. The refrigeration cycle apparatus of claim 1, wherein the first compressor and the second compressor are connected with each other via a pipe with flexibility.

* * * * *